US011666140B1

(12) United States Patent
Gruver

(10) Patent No.: US 11,666,140 B1
(45) Date of Patent: Jun. 6, 2023

(54) FOLDING TABLE

(71) Applicant: Dale Franklin Gruver, Tampa, FL (US)

(72) Inventor: Dale Franklin Gruver, Tampa, FL (US)

( * ) Notice: Subject to any disclaimer, the term of this patent is extended or adjusted under 35 U.S.C. 154(b) by 0 days.

(21) Appl. No.: 18/050,292

(22) Filed: Oct. 27, 2022

(51) Int. Cl.
*A47B 3/00* (2006.01)

(52) U.S. Cl.
CPC ..... *A47B 3/002* (2013.01)

(58) Field of Classification Search
CPC ..... A47B 3/002; A47B 3/08; A47B 13/02
See application file for complete search history.

(56) References Cited

U.S. PATENT DOCUMENTS

| | | | | |
|---|---|---|---|---|
| 3,188,158 | A * | 6/1965 | Johnson | A47B 3/002 312/277 |
| 4,321,875 | A * | 3/1982 | Danko | A47B 13/02 108/150 |
| 2008/0092786 | A1* | 4/2008 | Chen | A47B 3/08 108/131 |
| 2017/0354243 | A1* | 12/2017 | Egerhazy | A47F 5/16 |
| 2018/0140088 | A1* | 5/2018 | Saotome | A47B 13/02 |
| 2021/0062842 | A1* | 3/2021 | Chen | A47B 9/16 |

* cited by examiner

*Primary Examiner* — Daniel J Rohrhoff

(57) ABSTRACT

The invented round top folding table provides comfortable seating by eliminating physical interference with supporting table legs and guest's knees. Additionally it has a unique latch in the unfolded configuration which is secured by the force of gravity acting on the table top.

1 Claim, 1 Drawing Sheet

FOLDING TABLE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

Existing sixty inch diameter and larger commercial folding tables have legs which intrude into the knee space of the guests seated around it. Existing sixty inch diameter folding tables use folding legs which extend to the edge of the table top in at least four positions around the table's circumference and impact at least four guests when six or more guests are seated.

This is not only uncomfortable for at least four of the guest but it also can cause minor injuries to the guest's knees. So to improve the existing state of the art, a folding table with an extendable and retractable pedestal was invented to solved this problem by a pedestal which provides clearance for guest's knees. Additionally an extendable pedestal will require a safe and secure locking mechanism while the folding table is in use and the pedestal is extended. The pedestal is a scissors like construction which has been used in adjustable height machine and medical applications and usually motor driven. My search did not reveal any fixed height round, folding dining tables utilizing this concept.

ABSTRACT

A folding table with an extendable and retractable pedestal which allows comfortable seating around a fifty-rour inch or larger diameter table such that the comfortable seating affords sufficient clearance from the pedestal so every seating position is free from interference between the seated guest's knees and the supports which hold up the table top.

Additionally there is a mechanical latch which is locked by the weight of the table top.

BRIEF SUMMARY OF THE INVENTION

This folding table provides a more comfortable and safer guest experience by providing clearance around the perimeter of the table for the guest's knees. Additionally an easy to use safe and secure latching mechanism is provided for the extended pedestal with this invention.

DETAILED DESCRIPTION OF THE INVENTION

Figure 1:
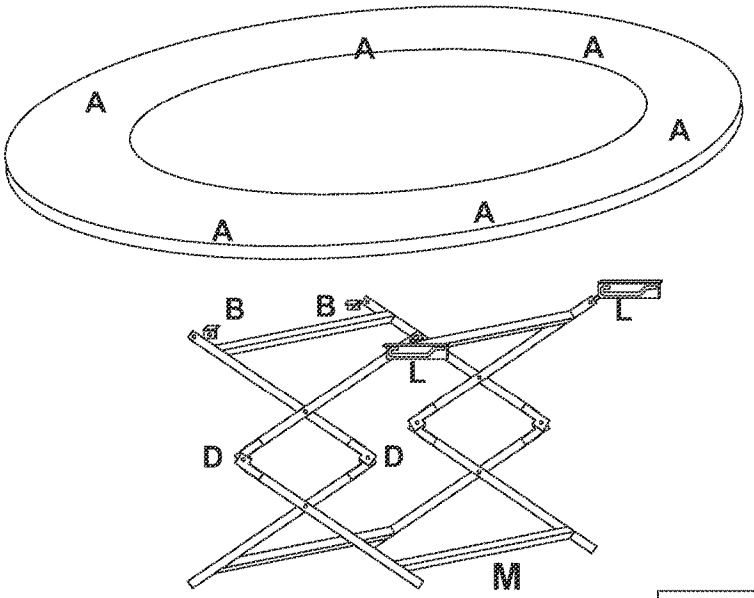
FIG. 1: An expanded view of the folding table.
Figure 2:
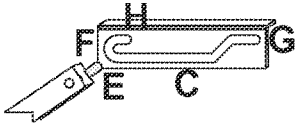
FIG. 2: The Latch Mechanism.

The invented folding table has a pedestal which when retracted is flush with the bottom of the table top. This retracted position allows the folded table to be rolled on the table top edge to a convenient storage place. When the pedestal is extended, the pedestal provides a stable base for the table but is configured such that no part of the supporting structure intrudes into the space normally occupied by seated guest's knees.

The folding table is comprised of clearance "A", pivot "B", secure latch "L" and scissor legs and scissor joint "D". The legs are connected by cross-members "M". Secure latch "L" is comprised of chaseway slot "C" which has a beginning "G" , an ending "H", a semi-circular path "F" and a cylindrical projection "E" at the top of the movable end of the pedestal.

Additionally the invention has a unique latch "L" as follows: The pedestal has two fixed pivots "B" on one side of the top and two cylindrical projections "E" on the other side of the top. The projection follows a slot in the chaseway "C" so when the pedestal is extended it retracts slightly after full extension as it travels around the semi-circular path "F" and is then held in position at the end of the slot "H" by the weight of the table top thus providing a safe and secure extended position.

The invention claimed is:

1. A folding table comprising: a round table top having a top, a bottom and a diameter and an extendable and retractable pedestal capable of providing a stable base for the table top;

the extendable and retractable pedestal comprising two scissor legs, each scissor leg extends and retracts in unison by pivoting about a scissor joint from an extended position to a retracted position where the pedestal is flush with the bottom of the table top, the extendable and retractable pedestal having a minimum footprint diameter that is at least 50% of the table top diameter and a maximum footprint diameter that is at least 24 inches less than the table top diameter; the extendable and retractable pedestal having a maximum height of 32 inches;

a latch comprising a cylindrical projection at the top of each scissor leg and two chaseways attached to the bottom of the tabletop; each chaseway comprising a curved slot; each cylindrical projection received in a slot of each chaseway; each slot shaped to allow the cylindrical projection to follow the slot from a beginning end of the slot, when the pedestal is in the retracted position, to an end of the slot, when the pedestal is in the extended position; the end of the slot comprising a semi-circular path which allows the pedestal to retract slightly to lock the extendable and retractable pedestal in the extended position.

* * * * *